United States Patent [19]

Gorman

[11] 4,330,304

[45] May 18, 1982

[54] FUEL ADDITIVE

[76] Inventor: Jeremy W. Gorman, 5 Cedar Hill Rd., West Simsbury, Conn. 06092

[21] Appl. No.: 263,219

[22] Filed: May 13, 1981

[51] Int. Cl.[3] ..... C10L 1/22

[52] U.S. Cl. ..... 44/63

[58] Field of Search ..... 44/63, 57, 72

[56] References Cited

U.S. PATENT DOCUMENTS

| | | | |
|---|---|---|---|
| 2,403,771 | 7/1946 | Vaughan et al. | 44/57 |
| 2,425,367 | 8/1947 | Denton et al. | 44/57 |
| 2,673,793 | 3/1954 | Brodhacker | 44/57 |
| 2,891,851 | 6/1959 | Bailey et al. | 44/57 |

*Primary Examiner*—Winston A. Douglas
*Assistant Examiner*—Y. Harris-Smith
*Attorney, Agent, or Firm*—Robert S. Smith

[57] ABSTRACT

A fuel additive to improve liquid fuel combustion efficiency which includes a nitroparaffin, a hydroperoxide, and propylene oxide. Ordinarily the nitroparaffin is between 3% and 65%, by weight, of the entire additive and the hydroperoxide is between ½% and 15%, by weight, of the entire additive and has a pH between 7.0 and 8.5. The propylene oxide ordinarily is between 1% and 20%, by weight, of the total weight of the additive.

9 Claims, No Drawings

FUEL ADDITIVE

BACKGROUND OF THE INVENTION

The present invention relates to fuel additives and particularly to hydrocarbon fuel additives intended to improve liquid fuel combustion efficiency. The benefits of the invention are not limited to any single liquid fuel. For example, the additive may be used with home heating fuel, diesel fuel, residual oil used in a large industrial burner, jet aircraft fuels, and other fuels.

Fuel additives of varying compositions have been known for over 40 years, and have demonstrated varying degrees of effectiveness. Only a few of those compositions either claimed to or actually do improve combustion efficiency, while many are useful as anti-sludging, anticorrosive, or anti-gelling agents.

The present invention is designed to improve combustion efficiency in a variety of combustion devices including gasoline and diesel engines, jet engines, boilers and other apparatus. Since other problems must also be encountered, this present invention is frequently combined with other components common to other additives for the additional purpose of anti-sludging, pour point suppression etc. None of these other components is either required by or a subject of the present invention.

The invention relies in part on:

1. Reduction in surface tension sufficient to reduce the droplet size. This results in a greater surface to volume ratio and faster and more complete burning. Faster burning is usually important to the combustion of fuels. For example, there is only a finite time period for burning within a reciprocating internal combustion engine.

2. Reduce the ignition delay. The ignition delay is the time between the application of a spark or the like and actual ignition. This is a very small period of time and the additive, in accordance with the invention, usually reduces the period by anywhere from one to three or four milliseconds.

3. Provides a catalytic oxidizer so the fuel burns a little faster.

The invention provides a combination of materials which makes a major difference. Some known additives having a carbon oxygen nitrogen bond such as nitrates have commonly been used in fuels. They are objectionable because they are generally very toxic and some are carcinogenic. Amyl nitrate, for instance, is an example of a substance which is objectionable.

SUMMARY OF THE INVENTION

It has now been found that the objects of the invention have been attained in a fuel additive to improve liquid fuel combustion efficiency which includes a nitroparaffin, a hydroperoxide, and propylene oxide.

The nitroparaffin may be between 3% and 65%, and ordinarily between 5% and 35%, by weight, of the entire additive. The hydroperoxide is preferably a cumene hydroperoxide because of price and availability, and may be between ½% and 15%, by weight, of the entire additive. The hydroperoxide should have a pH between 7.0 and 8.5. The hydroperoxide may be neutralized with 1% or less of a 50% aqueous solution of sodium or potassium hydroxide prior to use in the additive. Alternately the hydroperoxide is neutralized by saturation with ammonia gas just prior to mixing with the other ingredients of the additive. The propylene oxide may be between 1% and 20%, by weight, of the total weight of said additive.

Usually the propylene oxide is between 4% and 12%, by weight, of the entire additive.

DESCRIPTION OF THE PREFERRED EMBODIMENT

The three principle ingredients which are critically important to the system are:

1. A nitroparaffin in a quantity from 3% to 65% and preferably from 5% to 35%, by weight, of the entire additive.

2. A hydroperoxide, which may be a cumene hydroperoxide, in a quantity from ½% to 15% and preferably from 1% to 8% by weight of the entire additive.

3. Propylene oxide in a quantity from 1% to 20% and preferably from 4% to 12% by weight of the entire additive.

It will be understood that the term "nitroparaffin" is generic to the following substances: nitroethane, nitromethane, nitropropane, nitrobutane, and nitropentane. Nitromethane is less desirable than the other materials in this class because it is too volatile and under certain circumstances can be explosive.

(It will be understood that all percentages expressed herein are intended to be percentages by weight.)

Cumene hydroperoxide, is the hydroperoxide which is ordinarily utilized because it is manufactured in large quantities, has a relatively low price, and is readily available. Because fuel volumes to be treated are so large the ready availability is important. Ordinarily the hydroperoxide is activated or made more active in this particular system by making it very slightly basic (between pH 7.0 and 8.5). Hydroperoxides are very, very weak acids which ordinarily are neutralized in preferred compositions. The degree of neutralization is important because if you bring the pH of the system above 7.4 the nitroparaffin in this system becomes unstable. That is, it breaks down and forms formaldehyde and other gummy materials which may produce high pressures on the storage of shipping containers. This has been demonstrated experimentally with small quantities of a 50% solution of sodium hydroxide as the neutralizing agent. Too much hydroperoxide results in a pH level which allows spontaneous decomposition of the composition. It is desirable to keep the pH down but not to have an acidic composition. The pH of the hydroperoxide has to be very very closely controlled. There is an important and delicate balance required. The pH of the final composition must stay between 7.0 and 7.4.

It has been found that it is advantageous to saturate the cumene hydroperoxide with ammonia gas and that this will not adversely affect the nitroparaffin. Neutralization of hydroperoxide has not been used before in combination with the nitroparaffins, in part, because if the hydroperoxide is over neutralized the nitroparaffin tends to decompose. The hydroperoxide may be neutralized by adding 1% or less of a 50% aqueous solution of sodium or potassium hydroxide prior its use in this composition. In the preferred method the hydroperoxide is neutralized by bubbling ammonia gas through it just prior to mixing into the composition. The bubbling is continued until saturation of the hydroperoxide is attained. This results in a pH of between pH 7.0 and 8.5. Saturation is evident by the distinct odor of ammonia. The performance is outstanding when both a hydroperoxide and a nitroparaffin are present and it is essential that both be present. The hydroperoxide is a source of free radicals of which the nitroparaffins are transfer or carrier agents. The third component, propylene oxide, is a very low boiling point liquid, but it is a liquid at room temperature and has a very low flash point. This serves the function, without markedly decreasing the flash point of the fuel, of providing a low flash point to the fuel additive. It sharply decreases the ignition delay and also makes the flame front move faster in the fuel. This is of particular importance in a diesel engine where you may typically have only 15 milliseconds to burn the fuel within a cylinder. Unburned fuel will result in a lot of soot and smoke passing out the exhaust and, of course, indicates low efficiency.

Other components that may be used in the additive, for a variety of other purposes, include pour point suppressants and anti-sludging materials of which one is naphthalene. Napthalene is a commonly used fuel additive, as an anti-sludging additive. It seems occasionally to be a combustion improver. Methyl naphthalene is ordinarily advantageous over naphthalene because it is a liquid with a much lower pour point so it avoids problems with freezing or crystalizing out which is characteristic of naphthalene. Methyl naphthalene is also advantageous because it has a lower oxidation activation energy than naphthalene.

Chlorinated compounds appear to be effective in this composition, although they are not essential. If chlorine content is kept below a certain level the chlorine will not result in corrosive emissions. Small amounts of hydrogen chloride gas in the engine or burner exhaust are, contrary to general belief, anti-corrosive, instead of a corrosive to ferrous metals. Below about 4 parts/million hydrogen chloride is an anti-corrosive agent and tends to protect the metal in exhaust or stack systems. Above that concentration hydrogen chloride becomes corrosive, particularly in the presence of moisture.

The chlorinated compounds most in use are aromatic products such as orthodichlorobenzene, paradichlorobenzene or chlorobezene. In this composition aliphatic chlorinated hydrocarbons are preferred because they are a little less stable, and they break down more quickly to react with the burning fuel. The combustion of fuels involves a free radical process of some sort. It is believed the chlorine acts as a carrier for the free radicals rather than as a free radical generator. The hydroperoxide is a free radical generator and the nitroparaffin is a free radical carrier. Under certain circumstances nitroparaffins may be free radical generators. This contributes to the performance of the additive in accordance with the invention.

The nitroparaffins having a carbon to nitrogen bond are not as toxic as nitrates (with a carbon to oxygen to nitrogen bond). Even so 2-nitropropane is one of the former group that is suspected of some carcinogenic characteristics. Rats exposed to 200 parts/million, of 2-nitropropane, seven hours a day, five days per week for six months did develop cancer. But at 100 parts or 25 parts/million there was no effect.

The composition in accordance with the invention is particularly advantageous where a hydroperoxide neutralization process is employed. This neutralization is important because it makes the additive more active. It is important to avoid making the hydroperoxide too basic which would decompose the nitroparaffin. With extreme excesses the hydroperoxide may also tend to decompose in this situation. There is a very careful balance requirement in this system between pH 7.0 and 7.4.

The choice of components for a fuel additive is determined, in part, by the compatibility of the components. Acetone has been commonly used in additives, however, it is not suitable because acetone and nitroparaffin are incompatible. On the other hand, propylene oxide and nitroparaffin are totally miscible. Propylene oxide is also completely soluble in water. Since a certain amount of water is commonly mixed with many fuels, this is very important. It is also important because a small amount of water does make fuel combustion a little more efficient. Obviously, too much water will prevent combustion. A small amount does help because it tends to go through a water gas reaction to get rid of the carbon. This reaction involves carbon reacting with water to form hydrogen and carbon monoxide gas. These reaction products are both gaseous and combustible.

Tests results, which are superior to the results obtained with other commercial additives to which these compositions are compared, have been run. More specifically, comparisons against commercial products identified by the tradenames: Technol, XRG, Nutmeg and Fuel Improver have all been favorable. No other known composition was found to be superior to the compositions in accordance with the invention.

In various forms of the invention the additive may include varying amounts of caustic soda. Caustic soda in combination with a nitroparaffin is not known. None of these components is believed to have been used in combination with propylene oxide in a fuel additive. Most fuel additives for combustion improvement require chlorine. The present invention does not require chlorine although chlorine does appear to enhance combustion. Aliphatic chlorine is typically used in embodiments of the present invention which do include chlorine. The composition in accordance with the invention for use in leaded gasoline contains no chlorine, but for unleaded gasoline chlorine is included at a low level to reduce corrosion in the automobile exhaust system.

EXAMPLE I

A fuel oil additive is prepared having the following composition:

| | |
|---|---|
| Propylene Oxide | 100 grams |
| 1,1,1-Trichloroethane | 100 grams |
| Methyl Naphthalene | 100 grams |
| 1-Nitropropane | 200 grams |
| Cumene Hydroperoxide* | 40 grams |
| Xylene | 460 grams |

*Neutralized with a 1% by weight of a 50% aqueous solution of NaOH. (Ordinarily addition of 1% by weight is sufficient to give the desired pH.)

1 part additive added to 1024 parts gasoline (Mobil, regular leaded) (1 ounce for each 8 gallons) in a 1977 Honda Accord (12 gals., 1.5 oz.). The vehicle was driven from Simsbury, Connecticut to Granville, Vermont and return. Beginning mileage 79,181. At Greenfield, Massachusetts on the return trip at a mileage of 79,525 filled with 10.1 gallons of gasoline which corresponds to 34.06 mpg. Oct. 3 to 5, 1980).

Repeated the same trip October 10 to 12, 1980—same passenger load. Beginning mileage at same location 80,003. Mileage at Greenfield, Massachusetts was 80,332. Gasoline used (untreated) was 10.6 gallons which corresponds to 31.04 mpg. (Oct. 10–12, 1980)

The use of xylene diluent was to eliminate knocking caused by depression of octane rating by nitropropane.

EXAMPLE 2

| | |
|---|---|
| Propylene Oxide | 40 grams |
| Trichloroethylene | 100 grams |
| Methyl Naphthalene | 100 grams |
| 2-Nitropropane | 300 grams |
| Cumene Hydroperoxide* | 60 grams |
| Mineral Spirits | 400 grams |

*Treated with 1% by weight of 50% aqueous NaOH.

Comparison compositions were

1. Technol D—a commercial composition containing Acetone, Naphthalene, Orthodichlorobenzene and Toluene.
2. XRG—A commercial composition containing picric acid and ferrous salt in an organic solvent.

Dynamometer: Clayton Engine Dynamometer

Type of Engine: Mack 675-P

Type of Fuel: Shell No. 2 Diesel

| | RESULTS | | | | | | | |
|---|---|---|---|---|---|---|---|---|
| | Base | Ex.#2 | Tech.D | XRG | Ex.#2 | Tech.D | XRG | Base |
| RPM 2125+/−1% in each case | | | | | | | | |
| Dosage | | 1:1000 | 1:1000 | 1:1000 | 1:1600 | 1.1600 | 1.1600 | 1.1600 |
| BHP | 140 | 165 | 165 | 165 | 166 | 163 | 165 | 150 |
| SMOKE | Heavy Blk. | Lt. | Lt. | Lt. | | | | |
| CYCLE 15 min. in each case | | | | | | | | |
| NO. CYCLES | 1 | 2 | 3 | 4 | 4 | 2 | 3 | 1 |

Note each composition was tested at two different dosage rates as shown above. The test column shows data from any engine run with no fuel additive. The improvement in BHP in the second test run utilizing the base fuel over the initial run reflects engine cleaning effects from the additives.

Analysis of Data: (1) Example #2 Composition is at least as effective as, and perhaps slightly more effective than, the two other additives that are marketed.

| (2.) | % Change in Brake Horsepower | |
|---|---|---|
| | Example #2 Composition | 14.5% |
| | Technol D | 13.5% |
| | XRG | 14.06% |

EXAMPLE 3

| | |
|---|---|
| Propylene Oxide | 6% |
| Methyl Naphthalene | 10% |
| Nitroethane | 25% |
| Cumene Hydroperoxide | 6% |
| Toluene | 53% |

*Treated with 1% by weight of 50% aqueous KOH.

Consecutive tests run on a freshly rebuilt Detroit Diesel V-12 turbocharged Amtrak engine, on an engine dynamometer. The engine is rated at 550 H.P., but is warranted to produce 600 H.P. turbocharged.

At the end of the test the engine had about 1.5 hours of running time since being rebuilt. Comparisons were made on two 55 gallon drums of Amoco #1 Diesel fuel. The first part of the test was run on untreated fuel oil to establish a base line performance, the second part of the test was run on the same fuel treated 30 minutes before the test with 210 CC per drum (1 part per 1000 of fuel) of the composition described as example #3.

Run #1 (untreated) was 31 min. 28 seconds long, developed an average H.P. of 594.0, average r.p.m of 1789 and consumed 102.75 lbs. of fuel.

Run #2 (treated) was 31 min. 07 seconds long, developed an average H.P. of 605.7 average r.p.m. of 1802 and consumed 103.5 lbs. of fuel. Brake specific Horse power increased less than 1% power increased 2% and r.p.m. increased ¾%.

Calculations show the following:

| | TEST #1 (UNTREATED) | TEST #2 (TREATED 1/1000) |
|---|---|---|
| Duration (1) | 31.47 minutes | 31.12 minutes |
| RPM (max.min.ave.) | 1900,1775,1789 | 1890,1775,1802 |
| H.P. (2) (max.min.ave.) | 600,590,594.0 | 625,575,605.7 |
| Fuel used (3) | 102.75/lbs. | 103.5 lbs. |

(1) Measured by stop watch from time of adding first load to time of 0 load at shut down.
(2) Engine room air was forced into the engine, by the turbocharger and tended to decrease output as the room warmed up.
(3) Weighed on a Worthington platform scale with 500 lb. capacity and 2 oz. accuracy.

Calculations show the following:

| | TEST #1 (UNTREATED) | TEST #2 (TREATED) |
|---|---|---|
| Horsepower Hours/lb. of fuel | 3.030 | 3.035 |
| Maximum deliverable horsepower | 600 | 625 |
| Fuel flow/revolution | .0292 oz. | .0295 oz. |
| Fuel Flow (gph) | 27.55 | 28.07 |

EXAMPLE 4

| COMPOSITION | |
|---|---|
| 1-Nitropropanes and 2-Nitropropane (approx. equal quantities) | 250 cc. |
| Orthodichorobenzene | 100 cc. |
| Naphthalene | 100 grams |
| Propylene Oxide | 80 grams |
| Cumene hydroperoxide* | 40 grams |
| Toluene | 430 grams |

*Treated with 1% by weight of 50% aqueous NaOH.

Dynanometer: Froude, Type G Engine Dynamometer, Model GB-41

Type of Engine: Perkins 108, 4-cyl. Diesel, 107 cu.in. displacement rated at 52 BHP at 4000 rpm. and a 79 ft.-lb. torque load.

Type of Fuel: Amoco Premium Diesel: specific gravity of 0.837

Test Objective: To determine the effect of Example #4 Composition on brake horsepower and fuel consumption, in a newly rebuilt engine, operated at constant rpm (load), allowing for variation in fuel flow.

Test Method: Stabilize engine at constant rpm and temperature before beginning base readings.

Dosage—1:1000

| Misc. Data | |
|---|---|
| Barometer: | 30.20 |
| Rel. Hum.: | 82% |
| Temp. (F.): | Dry Bulb - 65 Wet bulb - 56 |

-continued

| | |
|---|---|
| Orthochlorobenzene | 8% |
| Naphthalene | 8% |
| Cumene Hydroperoxide (untreated) | 1% |
| Mixed Nitropropanes | 20% |
| Toluene | 55% |

NOL: A composition manufactured by the assignee of this application which is not in accordance with the invention.

RESULTS

| RPM | Torque Load | BHP | Exh.T | Water Jacket T | Time | Cycles | Fuel Used |
|---|---|---|---|---|---|---|---|
| Base 2000+/−1% | 67.80 | 30.0 | 800 F. | 164 F. | 2m 40s | 2 | 11.0 oz. |
| Comp.#4 2000+/−1% | 70.06 | 31.0 | 825 F. | 160 F. | 2m 40s | 2 | 10.0 oz. |

Analysis of Data:

Base: (11.0 oz./2 m 40s)=(0.688 lbs./160 sec.)=15.48 lbs./hr.

(15.28 lbs./hr./30 BHP)=0.516 lbs./BHP hr.

Comp.#4 (10.0 oz./2 m 40s)=(0.625 lbs./160 sec.)=14.06 lbs./hr.

(14.06 lbs./hr./31 BHP)=0.454 lbs./BHP hr.

% Reduction in Fuel Consumption=12.02%

EXAMPLE 5

Composition

Additive

Designation Composition

SPEC: A composition manufactured by the assignee of this application: and in accordance with the invention.

| | |
|---|---|
| Propylene Oxide | 8% |
| Trichloroethylene | 10% |
| Methyl Naphthalene | 20% |
| Cumene Hydroperoxide (treated) | 4% |
| Xylene | 48% |

MED: A composition manufactured by the BWM Corporation, of Bound Brook, N.J.

| | |
|---|---|
| Acetone | 8% |
| Naphthalene | 15% |
| Acetone | 15% |
| Orthodichlorobenzene | 15% |
| Toluene | 55% |

175-8: Technol D supplied by E.R.C. Technology, Inc., N.Y. Composition unknown.

175-11: A composition manufactured by the assignee which is in accordance with the invention.

| | |
|---|---|
| Propylene Oxide | 10% |
| 1,1,1-Trichloroethane | 10% |
| Methyl Naphthalene | 10% |
| Cumene Hydroperoxide (treated) | 4% |
| Nitropropanes | 20% |
| Xylene | 48% |

The objective of the following tests was to determine the relative effectiveness of these formulas in reducing fuel consumption when added to fuel oil at recommended treatment rates.

The test data is included in Table 1.

EXAMPLE 6

| | |
|---|---|
| Propylene Oxide | 8% |
| *Lubrisol 101 (2,5 Dimethyl, 2,5 Dihydroperoxy-hexane) | 7% |
| 1-Nitropropane | 25% |
| Trichloroethylene | 10% |
| Methylnaphthalene | 10% |
| Xylene | 40% |

*Neutralized with gaseous NH3.

TABLE 1

EVAPORATION RATE TEST OF TREATED FUELS

Test Boiler - Federal Boiler "XL" - Vertical Tubular
Test Burner - 1.00 GPH Pressure Atomizing
Fuel - #2 Oil - Treatment Rate - 1 to 4000
Test Objective - Determine Change in Evaporation rate between Treated and Untreated Fuel

| | Untreated Fuel Oil | Fuel Oil SPEC Added | Fuel Oil MED Added | Fuel Oil NOL Added | Fuel Oil 175-8 Added | Fuel Oil 175-11 Added |
|---|---|---|---|---|---|---|
| TEST CONDITIONS | | | | | | |
| 1. STM Pressure | Atmos. | Atmos. | Atmos. | Atmos. | Atmos. | Atmos. |
| 2. Water Temp. Entering Blr. | 68 F. | 68 F. | 68 F. | 68 F. | 68 F. | 68 F. |
| 3. STM Quality | NA | NA | NA | NA | NA | NA |
| 4. Air Temp. Ambient | 78 F. | 78 F. | 78 F. | 78 F. | 78 F. | 78 F. |
| 5. Gas Temp. Leaving Boiler | 605 F. | 605 F. | 605 F. | 605 F. | 605 F. | 605 F. |
| 6. Boiler Insulation | None | None | None | None | None | None |
| QUANTITIES | | | | | | |

TABLE 1-continued

EVAPORATION RATE TEST OF TREATED FUELS

Test Boiler - Federal Boiler "XL" - Vertical Tubular
Test Burner - 1.00 GPH Pressure Atomizing
Fuel - #2 Oil - Treatment Rate - 1 to 4000
Test Objective - Determine Change in Evaporation rate between Treated and Untreated Fuel

| | Untreated Fuel Oil | Fuel Oil SPEC Added | Fuel Oil MED Added | Fuel Oil NOL Added | Fuel Oil 175-8 Added | Fuel Oil 175-11 Added |
|---|---|---|---|---|---|---|
| 7. *Duration of Test (Apprx) | 45 min. | 45 min. | *30 min. | 45 min. | 45 min. | 45 min. |
| 8. Fuel Consumed | 5.25# | 5.187# | 3.625# | 5.1875# | 5.3125# | 5.3125 |
| 9. Weight of Water Evaporated | 54.875# | 58.25# | 40.185# | 57.685# | 57.687# | 59.74 |
| 10. Oil Htg.Valve (Reported) | 19,290BTU/# | *19,290BTU/# | 19,290BTU/# | 19,290BTU/# | 19,290BTU/# | 19,290BTU/ |
| 11. Enthalpy in Steam | 1150.4BTU/# | 1150.4BTU/# | 1150.4BTU/# | 1150.4BTU/# | 1150.4BTU/# | 1150.4BTU/ |
| 12. Enthalpy in F.W. | 34BTU/# | 34BTU/# | 34BTU/# | 34BTU/# | 34BTU/# | 34BTU/ |
| 13. Heat Absorbed per # Steam | 1116.4BTU/# | 1116.4BTU/# | 1116.4BTU/# | 1116.4BTU/# | 1116.4BTU/# | 1116.4BTU/ |
| OTHER PERTINENT DATA | Untreated | Fuel Oil 14. | Total Heat Input | | 101272.5BTU | 100066.8BTU |
| 69.926.25BTU 100066.8BTU | 102478.12BTU | 10.2478.12BTU | | | | |
| 15. Heat Output in STM | 61.262.45BTU | 65.030.3BTU | 44.862.5BTU | 64399.5BTU | 64401.7BTU | 66693.7BTU/ |
| 16. Radiant Losses from Boiler (Calculated) | 7097 BTU | 7097 BTU | 7097 BTU | 7097 BTU | 7097 BTU | 7097 BTU |
| 17. Radiant Losses from Comb. Chamber (Calculated) | 5090 BTU | 5090 BTU | 3393.8BTU | 5090 BTU | 5090 BTU | 5090 BTU |
| 18. Total Heat Output | 73459.45 BTU | 77217.3 BTU | 52987.3 BTU | 76586.5BTU | 76588.7BTU | 78880.7BTU |
| 19. Condenser Cooling Water Inlet Temperature | 68 F. | 68 F. | 68 F. | 68 F. | 68 F. | 68 F. |
| 20. *Condenser Cooling Water Outlet Temperature | 118 F. | 118 F. | 118 F. | 118 F. | 118 F. | 118 F. |
| 21. Condenser Cooling Water Rate | 3.2 GPH | 3.2 GPH | 3.2 GPH | 3.2 GPH | 3.2 GPH | 3.2 GPH |
| 22. Condensed Water Temperature | 104 F. | 104 F. | 104 F. | 104 F. | 104 F. | 104 F. |
| 23. Fuel Burner Pressure | 102# | 102# | 102# | 102# | 102# | 102 |
| 24. *Boiler Water Level During Test | 5" in Glass | 5" in Glass | 5" in Glass | 5" in Glass | 5" in Glass | 5" in Glass |
| 25. *Boiler Water Level End of Test | Unchanged | Unchanged | Unchanged | Unchanged | Unchanged | Unchanged |
| 26. Percentage Increase in | 0 | .0736 | .06 | .064 | .039 | .0775 |

*1. Test results for one (1) fifteen (15) minute cycle withdrawn because of disproportionate readings presumed to be erroneous.
2. Changes in BTU content of fuel with various formulas added are considered insignificant due to ratio of agent to oil.
3. Recorded elapsed times are approximate not precise to the second.
4. Indicated condenser outlet temperature is averaged for entire test period. Minor periodical deviations are ignored in this evaluation.
5. Boiler feed water rate set to maintain similar levels during testing periods. Minor fluctuations are ignored in this evaluation.

Using #2 fuel oil as the source for home heating and hot water at the rate of one pint per 200 gallons. The home owner claimed he had an 8% reduction in fuel used per a degree day and that his boiler was so clean at the time of a fall cleaning, the service man commented that the furnace had already been cleaned by someone else.

EXAMPLE 7

| | |
|---|---|
| Propylene Oxide | 10% |
| Tert - butyl hydroperoxide* | 2% |
| Nitropropanes (1 & 2) | 12% |
| Acetic Anhydride | 2% |
| Toluene | 74% |

*Saturated with Ammonia Gas.

1 oz. in the gas tank of 1971 Honda CL 350 motorcycle (2½ gallons). Left Mobil station in Greenfield, Massachusetts. North on Rt. I-91 to I-89 to Bethel, Vermont. 104 miles to Exxon Station using Mobile Premium gasoline used (octane 93.0) used 1.8 gallons. On return trip using Exxon Premium Gasoline (octane 93.0) distance was only 103 miles, used 2.1 gallons. Approximately a 17% increase in mileage.

The invention has been described with reference to its preferred embodiments. Persons skilled in the art of fuel additives may, upon exposure to the teachings herein, conceive variations. Such variations are deemed to be encompassed by the disclosure, the invention being delimited only by the appended claims.

Having thus described my invention I claim:

1. A fuel additive to improve liquid fuel combustion efficiency which comprises:

a nitroparaffin which is between 3% and 65%, by weight, of the entire additive;

a hydroperoxide which is between ½% and 15%, by weight, of the entire additive; and propylene oxide which is between 1% and 20%, by weight, of the entire additive.

2. The additive as described in claim 1, wherein: said nitroparaffin is between 5% and 35%, by weight, of the entire additive.

3. The additive as described in claim 1, wherein: said nitroparaffin is a nitropropane.

4. The additive as described in claim 1, wherein: said hydroperoxide is a cumene hydroperoxide.

5. The additive as described in claim 1, wherein: said hydroperoxide is between 1% and 8%, by weight, of the entire additive.

6. The additive as described in claim 1, wherein: said hydroperoxide has a pH between 7.0 and 8.5.

7. The additive as described in claim 1, wherein: said hydroperoxide is neutralized with 1% or less of a 50% aqueous solution of sodium or potassium hydroxide prior to use in said additive.

8. The additive as described in claim 1, wherein: said hydroperoxide is neutralized by saturation with ammonia gas just prior to mixing with the other ingredients of said additive.

9. The additive as described in claim 1, wherein: said propylene oxide is between 4% and 12%, by weight, of the total weight of said additive.

* * * * *

UNITED STATES PATENT AND TRADEMARK OFFICE

CERTIFICATE OF CORRECTION

PATENT NO. : 4,330,304

DATED : May 18, 1982

INVENTOR(S) : Jeremy W. Gorman

It is certified that error appears in the above-identified patent and that said Letters Patent are hereby corrected as shown below:

Column 7, line 44, cancel "Methyl Naphthalene 20%" and substitute --Methyl Naphthalene 10%
Nitropropane 20%--.

Column 8, line 46, cancel "Lubrisol" and insert -- Lupersol--.

Signed and Sealed this

Second Day of August 1983

[SEAL]

Attest:

GERALD J. MOSSINGHOFF

Attesting Officer

Commissioner of Patents and Trademarks